US008857633B2

(12) United States Patent
Dewhurst

(10) Patent No.: US 8,857,633 B2
(45) Date of Patent: Oct. 14, 2014

(54) CORRUGATED SHELVING DISPLAY SYSTEM WITH TWO-PIECE SHELVES

(71) Applicant: Menasha Corporation, Neenah, WI (US)

(72) Inventor: Doug Dewhurst, Berlin, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 13/918,086

(22) Filed: Jun. 14, 2013

(65) Prior Publication Data

US 2013/0277324 A1 Oct. 24, 2013

Related U.S. Application Data

(63) Continuation of application No. 12/870,380, filed on Aug. 27, 2010, now Pat. No. 8,485,370.

(60) Provisional application No. 61/239,261, filed on Sep. 2, 2009.

(51) Int. Cl.
*A47F 5/00* (2006.01)
*A47F 5/11* (2006.01)

(52) U.S. Cl.
CPC ..... *A47F 5/0018* (2013.01); *A47F 5/116* (2013.01)
USPC ..... 211/135; 211/149

(58) Field of Classification Search
USPC ..... 211/126.16, 149, 135, 72, 73, 153; 248/152, 174, 346.4; 229/120.08, 229/120.32, 120.21, 120.29; 220/4.29; 108/51.11, 51.3, 179
See application file for complete search history.

(56) References Cited

U.S. PATENT DOCUMENTS

| | | | |
|---|---|---|---|
| 1,827,008 | A | 10/1931 | Huckel |
| 1,912,847 | A | 6/1933 | Earl |
| 1,992,373 | A | 2/1935 | Johnson |
| 2,018,707 | A | 10/1935 | Daller |
| D104,437 | S | 5/1937 | Bulman |
| 2,339,656 | A | 1/1944 | Shina |
| D146,386 | S | 2/1947 | Shield |
| D153,188 | S | 3/1949 | Stensgaard |
| D158,775 | S | 5/1950 | Malkin |
| D158,776 | S | 5/1950 | Malkin |
| 2,706,066 | A | 4/1955 | Wells |
| 2,798,685 | A | 7/1957 | Mooney |

(Continued)

FOREIGN PATENT DOCUMENTS

| | | |
|---|---|---|
| EP | 0629557 | 12/1994 |
| JP | 06278746 | 10/1994 |

OTHER PUBLICATIONS

"Solid Wood Packing Materials to Argentina"; retrieved from http://www.corrugatedprices.com/pallets/swang.html; Feb. 5, 2002 (2 pages). Note: Applicant was unable to locate a copy of this reference, but believes that a copy is available to the Examiner in the application file for Application U.S. Appl. No. 12/621,221 at the U.S. Patent and Trademark Office.

(Continued)

*Primary Examiner* — Korie H Chan
(74) *Attorney, Agent, or Firm* — Ungaretti & Harris LLP

(57) ABSTRACT

A shelving display system formed from a single blank of corrugated material. The display system including a plurality of shelves formed from a first shelf component and a second shelf component.

21 Claims, 3 Drawing Sheets

(56) References Cited

U.S. PATENT DOCUMENTS

| | | | |
|---|---|---|---|
| 2,944,555 | A | 7/1960 | Peel et al. |
| 2,975,890 | A | 3/1961 | Block |
| 3,000,602 | A | 9/1961 | O'Brien |
| 3,026,015 | A | 3/1962 | Severn |
| 3,026,078 | A | 3/1962 | Simkins |
| 3,058,646 | A | 10/1962 | Guyer |
| 3,161,341 | A | 12/1964 | Farquhar |
| D204,434 | S | 4/1966 | Kingsford |
| 3,480,196 | A | 11/1969 | De Simas |
| 3,528,559 | A | 9/1970 | Miller |
| 3,690,118 | A | 9/1972 | Rainwater |
| 3,696,990 | A | 10/1972 | Dewhurst |
| 3,730,417 | A | 5/1973 | Lawson |
| 3,857,494 | A | 12/1974 | Giardini |
| 3,879,053 | A | 4/1975 | Chvala |
| 3,886,348 | A | 5/1975 | Jonathan et al. |
| 3,944,128 | A | 3/1976 | Hogan |
| D239,805 | S | 5/1976 | South |
| 4,004,691 | A | 1/1977 | Wihksne |
| D244,117 | S | 4/1977 | Naylor |
| 4,085,847 | A | 4/1978 | Jacalone |
| 4,099,813 | A | 7/1978 | Olivan |
| 4,171,741 | A | 10/1979 | Fish |
| 4,283,000 | A | 8/1981 | White |
| 4,292,901 | A | 10/1981 | Cox |
| 4,375,874 | A | 3/1983 | Leotta et al. |
| 4,376,558 | A | 3/1983 | Bandar |
| 4,503,973 | A | 3/1985 | Andersson |
| D278,493 | S | 4/1985 | Brescia et al. |
| 4,602,735 | A | 7/1986 | Aaron |
| 4,610,355 | A | 9/1986 | Maurer |
| 4,618,115 | A | 10/1986 | Belokin, Jr. |
| 4,658,984 | A | 4/1987 | Brunner |
| 4,673,092 | A | 6/1987 | Lamson et al. |
| 4,688,716 | A | 8/1987 | Winterling |
| D292,659 | S | 11/1987 | Svezia et al. |
| D293,520 | S | 1/1988 | Ovitz, III |
| 4,722,473 | A | 2/1988 | Sandrini et al. |
| D294,908 | S | 3/1988 | Childress |
| 4,765,492 | A | 8/1988 | Howard et al. |
| 4,793,664 | A | 12/1988 | Jackson |
| 4,826,265 | A | 5/1989 | Hockenberry |
| 4,836,379 | A | 6/1989 | Shaw |
| 4,850,284 | A | 7/1989 | DeGroot et al. |
| 4,852,756 | A | 8/1989 | Holldaday |
| 4,863,024 | A | 9/1989 | Booth |
| 4,871,067 | A | 10/1989 | Valenti |
| 4,877,137 | A | 10/1989 | Govang et al. |
| 4,911,084 | A | 3/1990 | Sato et al. |
| 4,936,470 | A | 6/1990 | Prindle |
| D321,100 | S | 10/1991 | Dorrell |
| D321,295 | S | 11/1991 | Nuebler |
| D321,615 | S | 11/1991 | Lavine et al. |
| 5,067,418 | A | 11/1991 | Carter |
| 5,119,740 | A | 6/1992 | Carter |
| 5,125,520 | A | 6/1992 | Kawasaki |
| 5,176,265 | A | 1/1993 | Bennett |
| D332,883 | S | 2/1993 | Staude |
| 5,195,440 | A | 3/1993 | Gottlieb |
| 5,213,220 | A | 5/1993 | McBride |
| 5,259,631 | A | 11/1993 | Brande |
| 5,269,219 | A | 12/1993 | Juvik-Woods |
| 5,272,990 | A | 12/1993 | Carter |
| D349,202 | S | 8/1994 | Eliadis et al. |
| D351,076 | S | 10/1994 | Eliadis et al. |
| 5,357,875 | A | 10/1994 | Winebarger et al. |
| 5,388,531 | A | 2/1995 | Crews et al. |
| 5,413,053 | A | 5/1995 | Vannatta |
| 5,427,019 | A | 6/1995 | Moorman |
| D362,768 | S | 10/1995 | Lechleiter et al. |
| D363,840 | S | 11/1995 | Weshler |
| 5,465,672 | A | 11/1995 | Boyse et al. |
| 5,487,344 | A | 1/1996 | Hutchison |
| 5,487,345 | A | 1/1996 | Winebarger et al. |
| D369,035 | S | 4/1996 | Potter |
| D369,043 | S | 4/1996 | Parker |
| 5,520,120 | A | 5/1996 | Badger |
| 5,528,994 | A | 6/1996 | Iseli |
| 5,540,536 | A | 7/1996 | Hoedl |
| 5,543,205 | A | 8/1996 | Liebel |
| 5,590,606 | A | 1/1997 | Crews et al. |
| 5,603,258 | A | 2/1997 | Besaw |
| 5,622,306 | A | 4/1997 | Grigsby et al. |
| 5,672,412 | A | 9/1997 | Phares et al. |
| 5,678,492 | A * | 10/1997 | Pinkstone et al. ..... 108/165 |
| 5,685,234 | A | 11/1997 | Grigsby et al. |
| D388,905 | S | 1/1998 | Wells |
| 5,706,953 | A | 1/1998 | Polvere |
| 5,711,423 | A | 1/1998 | Fuller, Jr. |
| D395,534 | S | 6/1998 | Besaw |
| 5,762,213 | A | 6/1998 | Heneveld, Sr. |
| 5,791,487 | A | 8/1998 | Dixon |
| 5,794,542 | A | 8/1998 | Besaw |
| 5,797,499 | A | 8/1998 | Pinco |
| D398,461 | S | 9/1998 | Baluk et al. |
| D398,462 | S | 9/1998 | Baluk et al. |
| 5,809,903 | A | 9/1998 | Young, Jr. |
| 5,816,172 | A | 10/1998 | Carter |
| 5,826,732 | A | 10/1998 | Ragsdale |
| 5,832,841 | A | 11/1998 | Crews et al. |
| 5,881,652 | A | 3/1999 | Besaw |
| D412,253 | S | 7/1999 | Brozak, Jr. |
| 5,918,744 | A | 7/1999 | Bringard et al. |
| 5,950,914 | A | 9/1999 | Dunton et al. |
| 5,980,008 | A | 11/1999 | Stoever |
| 5,996,366 | A | 12/1999 | Renard |
| 5,996,510 | A | 12/1999 | Harpman et al. |
| D419,275 | S | 1/2000 | Carter |
| D419,744 | S | 1/2000 | Carter |
| 6,012,399 | A | 1/2000 | Carter |
| 6,070,726 | A | 6/2000 | Graham |
| 6,076,475 | A | 6/2000 | Kuhn et al. |
| D428,738 | S | 8/2000 | Brozak, Jr. |
| 6,126,131 | A | 10/2000 | Tietz |
| 6,135,030 | A | 10/2000 | Besaw |
| D433,782 | S | 11/2000 | Carter |
| D433,839 | S | 11/2000 | Culbertson |
| 6,145,671 | A | 11/2000 | Riga et al. |
| 6,164,215 | A | 12/2000 | Cook et al. |
| 6,189,778 | B1 | 2/2001 | Kanter |
| D453,057 | S | 1/2002 | Sewell |
| 6,354,229 | B1 | 3/2002 | Heidtke |
| 6,357,587 | B1 | 3/2002 | Melms, Jr. |
| 6,394,003 | B1 | 5/2002 | Lacy, III |
| D461,334 | S | 8/2002 | Johnson et al. |
| D464,498 | S | 10/2002 | Riga et al. |
| 6,510,982 | B2 | 1/2003 | White et al. |
| 6,585,118 | B2 | 7/2003 | Kellogg |
| 6,612,247 | B1 | 9/2003 | Pistner et al. |
| 6,659,295 | B1 | 12/2003 | De Land et al. |
| 6,715,623 | B2 | 4/2004 | Broerman |
| 6,729,484 | B2 | 5/2004 | Sparkowski |
| 6,769,368 | B2 | 8/2004 | Underbrink et al. |
| D495,901 | S | 9/2004 | Bosman |
| 6,814,245 | B2 | 11/2004 | Leclerc et al. |
| 6,902,074 | B2 | 6/2005 | Albrecht |
| 6,905,021 | B2 | 6/2005 | Polumbaum et al. |
| D509,382 | S | 9/2005 | Raile |
| 6,951,300 | B2 | 10/2005 | Caille et al. |
| D521,275 | S | 5/2006 | Dusenberry |
| 7,036,196 | B2 | 5/2006 | Salatin et al. |
| 7,066,342 | B2 | 6/2006 | Baechle et al. |
| 7,066,380 | B2 | 6/2006 | Blake |
| 7,089,872 | B2 | 8/2006 | Wintermute, II et al. |
| 7,111,735 | B2 | 9/2006 | Lowry |
| D533,734 | S | 12/2006 | Campbell |
| 7,191,906 | B1 | 3/2007 | Pinco |
| 7,234,604 | B2 | 6/2007 | Eisele |
| D566,989 | S | 4/2008 | Mason |
| D576,426 | S | 9/2008 | Yuen-Schat et al. |
| D578,804 | S | 10/2008 | Norman et al. |
| 7,546,926 | B2 | 6/2009 | Stolle et al. |
| 7,546,927 | B2 | 6/2009 | Lowry et al. |
| D603,189 | S | 11/2009 | Raile |

(56) References Cited

U.S. PATENT DOCUMENTS

| | | | | |
|---|---|---|---|---|
| 7,650,996 | B2 | 1/2010 | Mark | |
| 7,677,433 | B2 | 3/2010 | Little | |
| 7,703,665 | B2 | 4/2010 | McGowan | |
| 7,703,864 | B2 | 4/2010 | Moser | |
| 7,717,265 | B2 | 5/2010 | Honkawa et al. | |
| 7,726,474 | B2 | 6/2010 | Berger et al. | |
| 7,828,169 | B2 | 11/2010 | Robinson et al. | |
| 7,905,365 | B2 * | 3/2011 | Virvo | 211/73 |
| 7,992,716 | B2 | 8/2011 | Jackson | |
| 8,002,171 | B2 | 8/2011 | Ryan et al. | |
| 8,141,713 | B2 | 3/2012 | Farkas et al. | |
| 8,317,039 | B2 | 11/2012 | Norman | |
| 8,485,370 | B2 | 7/2013 | Dewhurst | |
| 2002/0189507 | A1 | 12/2002 | Benner | |
| 2003/0042828 | A1 | 3/2003 | Bonin | |
| 2003/0111383 | A1 | 6/2003 | Qiu et al. | |
| 2005/0252872 | A1 | 11/2005 | Eisele | |
| 2006/0006096 | A1 | 1/2006 | Funk | |
| 2006/0283775 | A1 | 12/2006 | Mark | |
| 2007/0193479 | A1 | 8/2007 | Slaats | |
| 2008/0169340 | A1 * | 7/2008 | Sheffer | 229/120.32 |
| 2008/0265726 | A1 * | 10/2008 | Sheffer | 312/259 |
| 2009/0107940 | A1 | 4/2009 | Norman et al. | |
| 2009/0127150 | A1 | 5/2009 | Meers | |
| 2010/0133215 | A1 | 6/2010 | Norman | |
| 2011/0000955 | A1 | 1/2011 | Manteufel et al. | |
| 2011/0049072 | A1 | 3/2011 | Dewhurst | |
| 2011/0266177 | A1 | 11/2011 | Lowry et al. | |
| 2012/0074037 | A1 | 3/2012 | Orischak et al. | |
| 2013/0097903 | A1 | 4/2013 | Gerstner | |
| 2013/0213915 | A1 | 8/2013 | Pfeifer et al. | |

OTHER PUBLICATIONS

LeBlanc, R.; "Limits on Export Pallets Creating Corrugated Window of Opportunity; Corrugated Pallet Suppliers Experiencing Renewed Interest for Export, Domestic Markets": retrieved from http://www.palletenterprise.com/articledatabase/view.asp?articleID+649; Apr. 1, 2002 (7 pages).

* cited by examiner

CORRUGATED SHELVING DISPLAY SYSTEM WITH TWO-PIECE SHELVES

CROSS-REFERENCE TO RELATED APPLICATIONS

The present application is a continuation of U.S. patent application Ser. No. 12/870,380 filed Aug. 27, 2010, which claims the benefit of U.S. Provisional Patent Application No. 61/239,261 filed Sep. 2, 2009, the contents of which are incorporated herein by reference.

FEDERALLY SPONSORED RESEARCH OR DEVELOPMENT

N/A

FIELD OF THE INVENTION

The present invention generally relates to a shelving display system formed from a single blank that, in turn, is formed from a single sheet of corrugated material, having a plurality of shelves including a first panel and a second panel.

BACKGROUND OF THE INVENTION

A variety of systems are used to display merchandise. Some of these systems can be costly and difficult to manufacture, as well as ship or set up on site.

The present invention provides an embodiment of a corrugated shelving display system that overcomes the problems of prior display systems.

SUMMARY OF THE INVENTION

The present invention provides an embodiment of a corrugated shelving display system formed from a single blank of corrugated material, such as cardboard. The shelving display system includes a plurality of shelves, wherein each shelf is formed from a first panel and a second panel. The first and second panels being cut out and folded from separate wall segments of the single blank of corrugated material.

In accordance with one embodiment of the invention, a shelving display system comprises a back wall, a first side wall extending from a first side of the back wall toward a front portion of the display system and a second side wall extending from a second side of the back wall toward a front portion of the display system. The display system further includes a plurality of shelves formed from a first shelf component and a second shelf component extending between the first side wall and the second side wall. The first shelf component is provided by a first shelf panel extending between the first side wall and the second side wall approximately midway from the back wall to the front portion of the display system and the second shelf component is provided by a second shelf panel extending between the first side wall and the second side wall proximate the front portion of the display system.

The first shelf panel is integrally connected to a strip of material glued to an interior surface of one of the first and second side walls. The first shelf panel is also integrally connected to a positioning panel that positions the first shelf panel at the midway portion of the first and second side walls. The first shelf components are folded downward toward the back wall.

When set up, an interior surface of one of the first and second side walls is glued to an exterior surface of the positioning panel. This can position the second shelf panel across the front portion of the display system. The second shelf components are then folded toward the first shelf components and are interlocked with the first shelf components. The first shelf components can include a slot that cooperates with a tab positioned on the second shelf components to enable the components to interlock. The shelves can include vertically positioned front panels.

The back wall, side walls, and plurality of shelves can be formed from a corrugated material. The material can be a single blank that can be folded into the display system.

In accordance with another embodiment of the invention, a stand-alone shelving display comprises a single blank of corrugated material foldable to include: a back wall, a first side wall positioned on a first side of the back wall, a second side wall positioned on a second side of the back wall, and a plurality of shelves extending between the first side wall and the second side wall. The plurality of shelves are formed from a first shelf panel having a plurality of first shelf components and a second shelf panel having a plurality of second shelf components configured to interlock with the first shelf components.

The stand-alone shelving display can further comprise a positioning panel integrally connected on a first side to the first shelf panel and integrally connected on a second side to the back panel. The positioning panel is foldable to position the first shelf panel approximately to a middle portion of the first and second side walls.

The first shelf component can include a slot and the second shelf component can include a tab positioned for insertion into the slot to interlock the components.

In accordance with another aspect of the invention, a blank of corrugated material for creating a shelving display system having two part shelves is provided. The blank comprises a back wall panel integrally connected on a first side to a first side of a positioning panel. The positioning panel is integrally connected on a second side to a first side of a first shelf panel. The back panel is integrally connected on a second side to a first side of a first side wall panel. The first side wall panel is integrally connected on a second side to a first side of a second shelf panel, and the second shelf panel is integrally connected on a second side to a first side of a second side wall panel.

The first shelf panel includes a plurality of first shelf components, and the second shelf panel includes a plurality of second shelf components. The first and second shelf components can be interlocked.

The blank further comprises a glue strip panel integrally connected to a second side of the first shelf panel.

Other features and advantages of the invention will be apparent from the following specification taken in conjunction with the following Figures.

BRIEF DESCRIPTION OF THE FIGURES

To understand the present invention, it will now be described by way of example, with reference to the accompanying Figures in which.

DETAILED DESCRIPTION OF THE INVENTION

While this invention is susceptible of embodiments in many different forms, there is shown in the Figures and will herein be described in detail preferred embodiments of the invention with the understanding that the present disclosure is to be considered as an exemplification of the principles of the invention and is not intended to limit the broad aspect of the invention to the embodiments illustrated.

Figure 6:
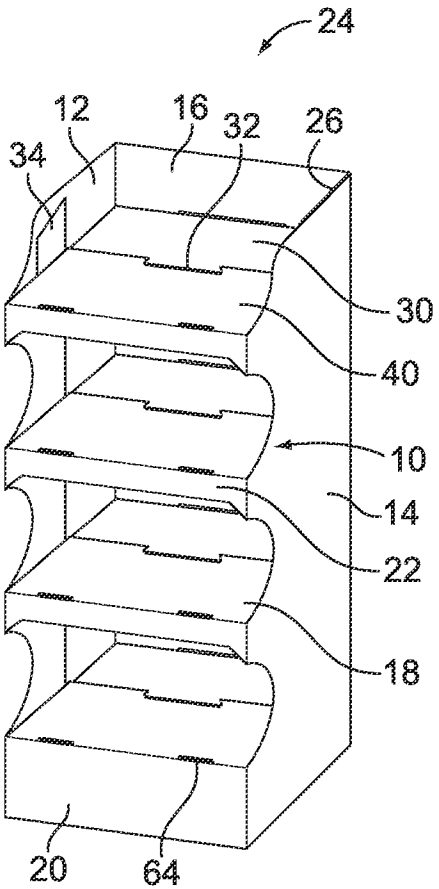
Figure 5:
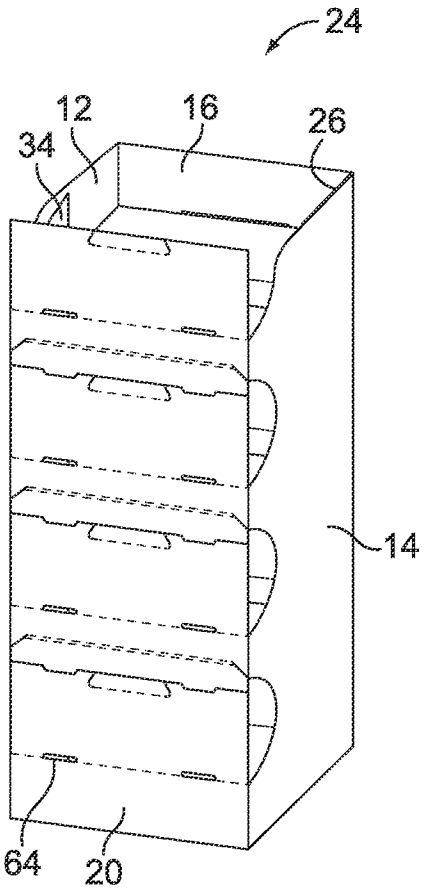
FIG. 5 is a perspective view of the blank of FIG. 1 further folded from the position in FIG. 4; and, FIG. 6 is a front perspective view of a shelving display system having two-part shelves in accordance with the present invention.
Figure 4:
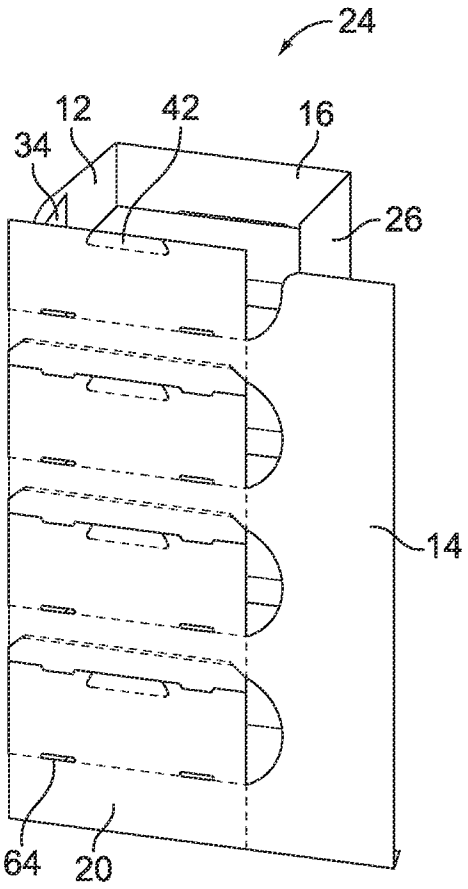
FIG. 4 is a perspective view of the blank of FIG. 1 further folded from the position in FIG. 3.

A shelving display system 10 is shown set-up in FIG. 6. The shelving display system 10 includes a first side wall 12 and a second side wall 14. The first and second side walls 12, 14 extend from a back wall 16.

A plurality of shelves 18 are supported between the first side wall 12 and the second side wall 14. The bottom shelf of the plurality of shelves 18 includes a front panel 20 that extends downward to the floor to form a base of the shelving display system 10 along with lower portions of the first side wall 12, the second side wall 14 and the back wall 16. Each of the remaining shelves of the plurality of shelves 18, include a front panel 22 that extends downward a distance shorter than the front panel 20 of the bottom shelf of the plurality of shelves 18.

The embodiment shown in FIG. 6 includes four shelves 18. However, a shelving display system made in accordance with the inventions of the present application can include more or fewer shelves. As discussed below, each of the plurality of shelves 18 is formed from two parts—a first shelf component is provided from a first shelf panel 28, and a second shelf component is provided from a second shelf panel 38.

Figure 1:
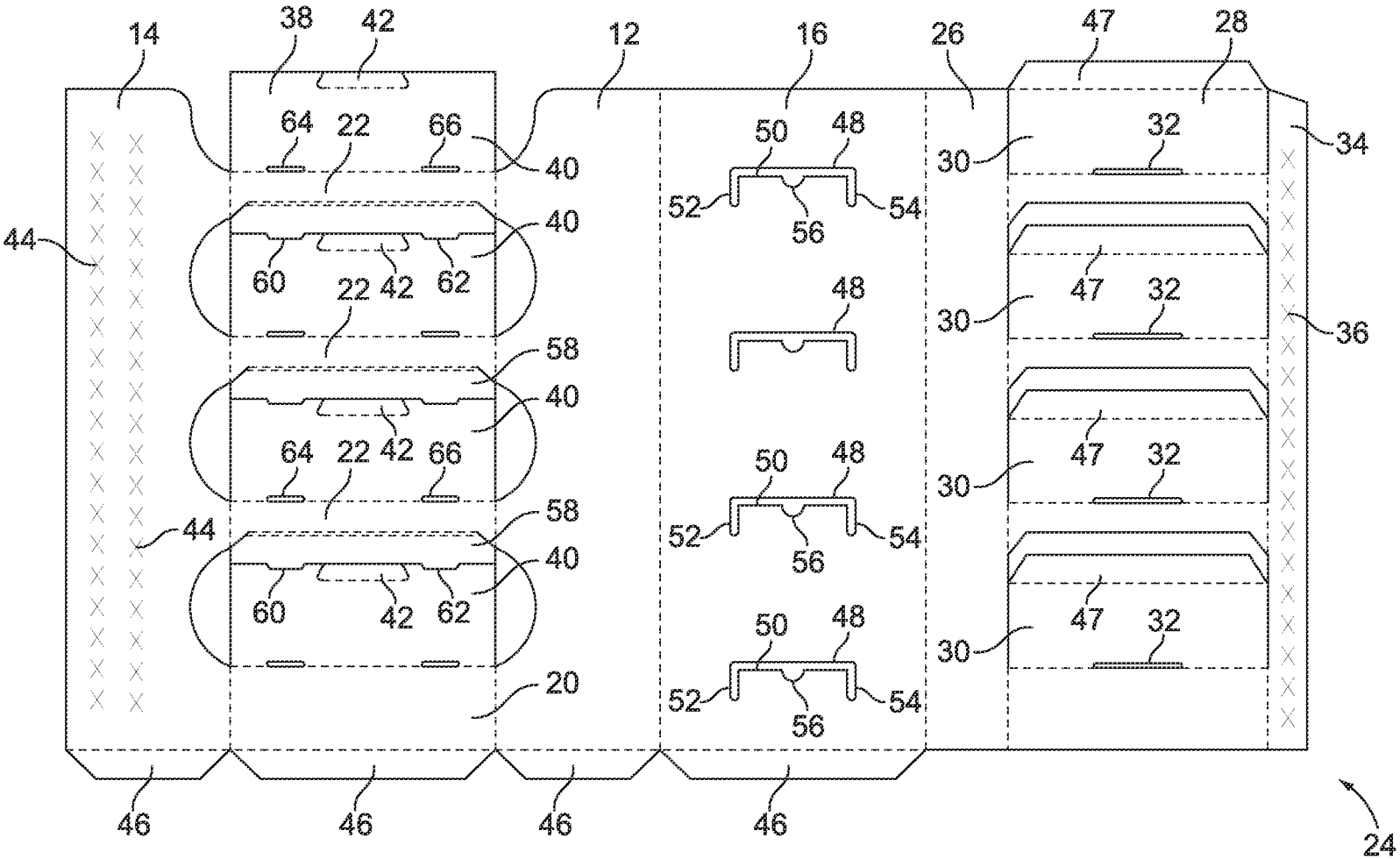
FIG. 1 is a plan view of a blank of corrugated material for constructing the shelving display system of FIG. 1.
Figure 3:
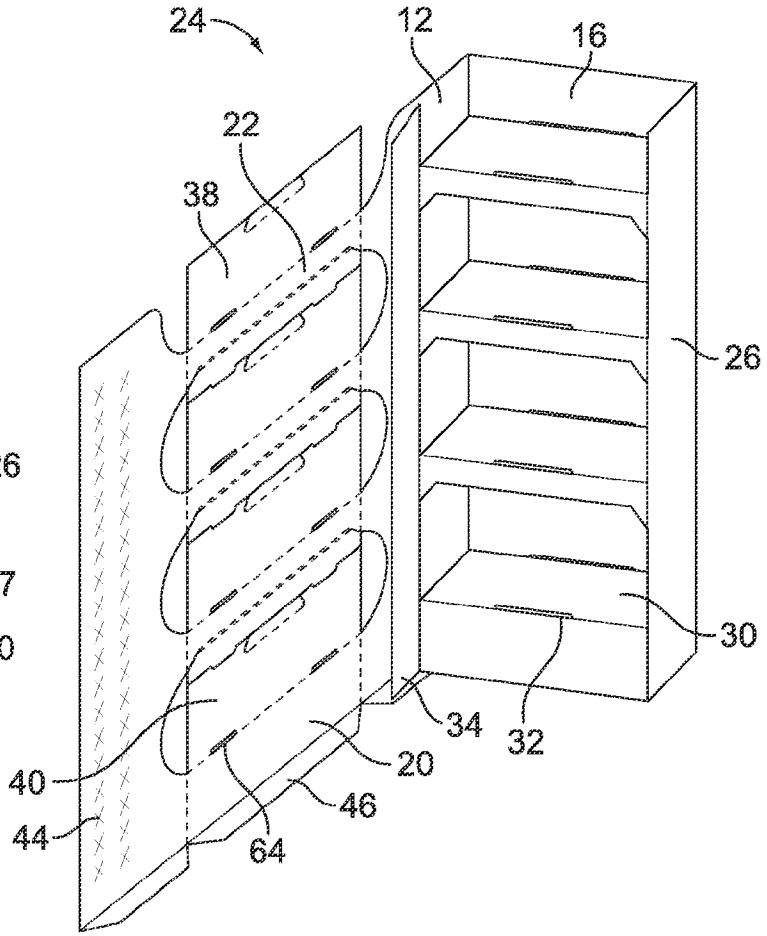
FIG. 3 is a perspective view of the blank of FIG. 1 further folded from the position in FIG. 2.
Figure 2:
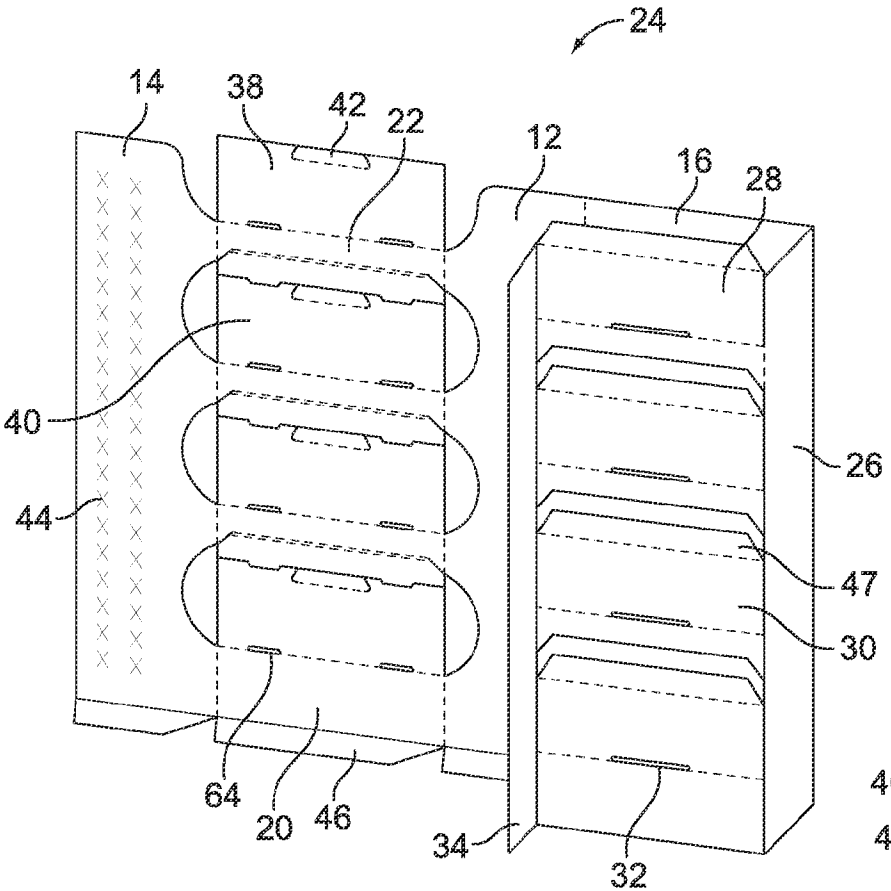
FIG. 2 is a perspective view of the blank of FIG. 1 partially folded into a shelving display system.

Referring to FIG. 1, a blank of corrugated material 24 is shown that can be set up into the shelving display system 10 shown in FIG. 6. As shown progressively in FIGS. 2-5, the blank 24 is folded into the proper shape and glued into place. Dashed lines on the blank 24 generally indicate fold lines where the blank 24 is folded to create the shelf display system shown in FIG. 6. Certain bold lines indicate cut or perforated lines on the blank 24.

The blank 24 includes a back panel which forms the back wall 16. A panel that forms the first side wall 12 is integrally connected on one side to a first side of the panel that forms the back wall 16. The panel that forms the back wall 16 is integrally connected on its other side to a first side of a positioning panel 26.

The positioning panel 26 is integrally connected on a second side to one side of a first shelf panel 28. The first shelf panel 28 includes a plurality of first shelf components 30. Each of the first shelf components 30 includes a slot 32. As explained below, the first shelf components 30 are utilized to form the shelves 18 shown in FIG. 6.

A relatively thin strip panel 34 is integrally connected to the other side of the first shelf panel 28. The thin strip panel is provided with glue for securing the panel to another portion of the shelf display system 24. A plurality of "X's" 36 are used to generally indicate the preferred areas for applying the glue.

The first side wall 12 is integrally connected on an opposing side (to the side connected to the back wall panel 16) to a first side of a second shelf panel 38. The second shelf panel 38 includes a plurality of second shelf components 40. The plurality of second shelf components 40 correspond to the plurality of first shelf components 30. Each of the plurality of second shelf components 40 includes a tab portion 42. The lower most shelf of the plurality of second shelf components 40 includes the front panel 20 that, in part, forms the base of the shelving display system 10.

The second shelf panel 38 is integrally connected on a second side to a panel that forms the second side wall 14. The second side wall 14 also includes glue areas designated by "X's" 44.

The blank 24 also includes bottom flaps 46 extending downward from the first and second side walls 12, 14, the back wall 16 and the second shelf panel 38. The bottom flaps 46 are folded under the shelving display system 10 when set up and form part of the base portion To set up the shelving display system 10 from the blank 24, both the first side wall 12 and the positioning panel 26 are folded forward to be at a right angle with respect to the back wall 16. The first shelf panel 28 is then folded toward the first side wall 12, and the thin strip 34 is glued to an interior surface of the first side wall 12. This supports the first shelf panel 28 parallel to the back wall 16 at a distance equal to the width of the positioning panel 26.

The first shelf components 30 can be folded back toward the back wall 16 to form a back portion for each of the plurality of shelves 18. The first shelf components 30 can be glued to the back wall 16, or include structure, such as a tab 47, that can fit in slots 48 in the back wall 16. The slot 48 includes a horizontal portion 50 and two vertical portions 52, 54 on either side of the horizontal portion 50. A U-shaped opening 56 proximate the middle of the horizontal portion 50 is provided to allow one to pull a portion of the back wall 16 defined by the slots 48 and allow for placement of the tabs 47.

The second shelf panel 38 is folded across the first shelf panel 28, and the second side wall 14 is folded back toward the back wall 16. The glue on the second side wall 14 is used to secure the second side wall 14 to an outer surface of the positioning panel 26.

Once the second shelf panel 38 is positioned, the plurality of second shelf components 40 can be folded back toward the back wall 16 to form a complete shelf with the first shelf components 30 from the first shelf panel 28. The tabs 42 on the second shelf components 40 can be inserted into the slots 32 on the first shelf components 30 to lock the first shelf component 30 to the second shelf component 40.

A reinforcing panel 58 extends below each of the front panels 22. The reinforcing panel 58 includes a first tab 60 and a second tab 62. The reinforcing panel 58 is folded under the front panel 22 and the first and second tabs 60, 62 are inserted into corresponding first and second slots 64, 66 on the top edge of the front panel 22 and the second shelf component 40.

While the specific embodiments have been illustrated and described, numerous modifications come to mind without significantly departing from the spirit of the invention and the scope of protection is only limited by the scope of the accompanying Claims.

I claim:

1. A shelving display system formed from a single contiguous blank of material comprising:

a first side wall panel;

a second side wall panel;

a first shelf panel having a plurality of horizontal first shelf components, each of the plurality of horizontal first shelf components forming a first portion of a shelf;

a second shelf panel having a plurality of horizontal second shelf components, each of the plurality of horizontal second shelf components aligning with a corresponding one of the plurality of first shelf components and forming a second portion of the shelf; and, a support panel having a plurality of slots, each slot aligning with one of the plurality of second shelf components on the second shelf panel and the corresponding one of the plurality of first shelf components on the first shelf panel.

2. The shelving display system of claim 1 wherein each panel is formed from a corrugated material.

3. The shelving display system of claim 1 wherein each of the plurality of first shelf components includes a slot.

4. The shelving display system of claim 3 wherein each of the plurality of second shelf components include a tab configured to interlock with the slot in the corresponding first shelf component to secure each second shelf component to the corresponding first shelf component.

5. The shelving display system of claim 1 further comprising a plurality of bottom flaps forming a base of the system.

6. The shelving display system of claim 1 further comprising a positioning panel connected to the support panel on a first side of the positioning panel and the first shelf panel on a second side of the positioning panel.

7. The shelving display system of claim 6 further comprising a glue panel.

8. The shelving display system of claim 6 wherein an interior surface of one of the first and second side wall panels is glued to an exterior surface of the positioning panel.

9. The shelving display system of claim 1 wherein the blank of material is formed from plastic.

10. The shelving display system of claim 1 wherein the first shelving component includes a vertically positioned panel.

11. A shelving display system comprising:

a first side wall panel;

a second side wall panel;

a first shelf panel having a plurality of first horizontal shelf components, each of the first horizontal shelf components having a slot;

a second shelf panel having a plurality of second horizontal shelf components, each second horizontal shelf component substantially aligned with a corresponding one of the plurality of first horizontal shelf components of the first shelf panel, each second horizontal shelf component including a tab interlocked with the slot of the corresponding first horizontal shelf component; and, a support panel having a plurality of slots, each slot aligning with one of the plurality of second shelf components on the second shelf panel and the corresponding one of the plurality of first shelf components on the first shelf panel.

12. The shelving display of claim 11 further comprising a plurality of bottom flaps forming a base.

13. The shelving display system of claim 11 further comprising a positioning panel connected to a first side of the first shelf panel.

14. The shelving display system of claim 13 further comprising a glue panel.

15. The shelving display system of claim 13 wherein an interior surface of one of the first and second side wall panels is glued to an exterior surface of the positioning panel.

16. The shelving display system of claim 11 wherein the first shelving component includes a vertically positioned panel.

17. The shelving display system of claim 11 further comprising a plurality of top flaps for forming a top wall.

18. The shelving display system of claim 11 wherein the shelving display system is formed from a corrugated material.

19. The shelving display system of claim 18 wherein the shelving display system is formed from a single blank of material.

20. The shelving display system of claim 11 wherein the shelving display system is formed from plastic.

21. A shelving display system formed from a single contiguous blank of material comprising:

a first side wall panel;

a second side wall panel;

a first shelf panel having a plurality of first shelf components, each of the plurality of first shelf components including a slot;

a second shelf panel having a plurality of second shelf components, each of the plurality of second shelf components aligning with a corresponding one of the plurality of first shelf components and each of the plurality of second shelf components including a tab configured to interlock with the slot in the corresponding first shelf component to secure each second shelf component to the corresponding first shelf component; and, a support panel having a plurality of slots, each slot aligning with one of the plurality of second shelf components on the second shelf panel and the corresponding one of the plurality of first shelf components on the first shelf panel.

* * * * *